US007728782B2

(12) United States Patent
Watson et al.

(10) Patent No.: US 7,728,782 B2
(45) Date of Patent: Jun. 1, 2010

(54) VERSATILE WIDEBAND PHASED ARRAY FED REFLECTOR ANTENNA SYSTEM AND METHOD FOR VARYING ANTENNA SYSTEM BEAMWIDTH

(75) Inventors: Timothy D. Watson, Castle Rock, CO (US); Thomas P. Cencich, Sr., Littleton, CO (US); Jeannette C. McDonnell, Littleton, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 143 days.

(21) Appl. No.: 12/030,812

(22) Filed: Feb. 13, 2008

(65) Prior Publication Data

US 2009/0201213 A1 Aug. 13, 2009

(51) Int. Cl.
*H01Q 19/12* (2006.01)

(52) U.S. Cl. ..... 343/840; 343/895

(58) Field of Classification Search ..... 343/840, 343/895, 779, 781 R

See application file for complete search history.

(56) References Cited

U.S. PATENT DOCUMENTS 3,587,106 A 6/1971 Crooks et al.
6,208,312 B1 * 3/2001 Gould ..... 343/840
7,034,771 B2 * 4/2006 Rao et al. ..... 343/840
7,315,279 B1 1/2008 Milbourne
2004/0189538 A1 * 9/2004 Rao et al. ..... 343/757
2005/0052333 A1 * 3/2005 Rao et al. ..... 343/840

* cited by examiner

*Primary Examiner*—HoangAhn T Le
(74) *Attorney, Agent, or Firm*—McDermott Will & Emery LLP

(57) ABSTRACT

An antenna system includes a reflector having a focal point, and a phased array having feed elements. Each feed element is disposed a same distance from the focal point of the reflector. A method for varying the beamwidth of an antenna system includes providing the antenna system with a reflector having a focal point and feed elements disposed a same distance from the focal point. The feed elements includes one or more inner feed elements and one or more outer feed elements. The method further includes adjusting relative amplitudes of the inner feed elements and the outer feed elements to adjust the beamwidth of the antenna system. An antenna system includes a parabolic reflector having a focal point, and a phased array having one or more inner feed elements and one or more outer feed elements. Each of the feed elements is disposed a same distance in wavelengths from the focal point, and is oriented towards the focal point.

17 Claims, 15 Drawing Sheets

801 array feed
802 array, x-pol
803 center element only
804 center, x-pol 1001 array feed
1002 array, x-pol
1003 center element only
1004 center, x-pol 1101 array feed
1102 array feed, x-pol
1103 center element feed
1104 center element, x-pol 1201 array feed
1202 array feed, x-pol
1203 center element feed
1204 center element, x-pol 1301 array feed
1302 array feed, x-pol
1303 center element feed
1304 center element, x-pol

VERSATILE WIDEBAND PHASED ARRAY FED REFLECTOR ANTENNA SYSTEM AND METHOD FOR VARYING ANTENNA SYSTEM BEAMWIDTH

STATEMENT REGARDING FEDERALLY SPONSORED RESEARCH OR DEVELOPMENT

Not applicable.

FIELD OF THE INVENTION

The present invention generally relates to antenna systems and, in particular, relates to versatile wideband phased array fed reflector antenna systems and methods for varying antenna system beamwidth.

BACKGROUND OF THE INVENTION

Many communications systems manage co-channel interference (e.g., multiple signals that simultaneously use the same RF channel) via several techniques, such as power control, spatial separation, orthogonal coding and antenna directivity. As the demands placed on these communications systems increase, the distance between geographic areas that utilize overlapping RF channels shrinks. Accordingly, it is desirable to provide communications systems with variable beamwidth that provide service to smaller geographical areas to reduce overlapping coverage. Many variable beamwidth systems, however, suffer from poor wideband performance.

SUMMARY OF THE INVENTION

The present invention solves the foregoing problems by providing an antenna system with variable beamwidth that enjoys excellent wideband performance. This antenna system addresses the co-channel problem from a spatial perspective, operating as a tunable spatial filter over a wide instantaneous RF bandwidth. Embodiments of the antenna system enjoy variable beamwidth with instantaneous wideband (e.g., 5:1 bandwidth) performance.

According to one embodiment of the present invention, an antenna system is provided. The antenna system comprises a reflector having a focal point, and a phased array having a plurality of feed elements. Each of the plurality of feed elements is disposed a same distance from the focal point of the reflector.

According to another embodiment of the present invention, an antenna system comprises a parabolic reflector having a focal point, and a phased array having one or more inner feed elements and one or more outer feed elements. Each of the one or more inner feed elements and the one or more outer feed elements is disposed a same distance in wavelengths from the focal point of the reflector, and is oriented towards the focal point of the reflector.

According to another embodiment of the present invention, a method for varying the beamwidth of an antenna system comprises the step of providing the antenna system with a reflector having a focal point and a plurality of feed elements disposed a same distance from the focal point. The plurality of feed elements includes one or more inner feed elements and one or more outer feed elements. The method further comprises the step of adjusting relative amplitudes of the one or more inner feed elements and the one or more outer feed elements to adjust the beamwidth of the antenna system.

It is to be understood that both the foregoing summary of the invention and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of this specification, illustrate embodiments of the invention and together with the description serve to explain the principles of the invention. In the drawings.

DETAILED DESCRIPTION OF THE INVENTION

In the following detailed description, numerous specific details are set forth to provide a full understanding of the present invention. It will be apparent, however, to one ordinarily skilled in the art that the present invention may be practiced without some of these specific details. In other instances, well-known structures and techniques have not been shown in detail to avoid unnecessarily obscuring the present invention.

Figure 1:
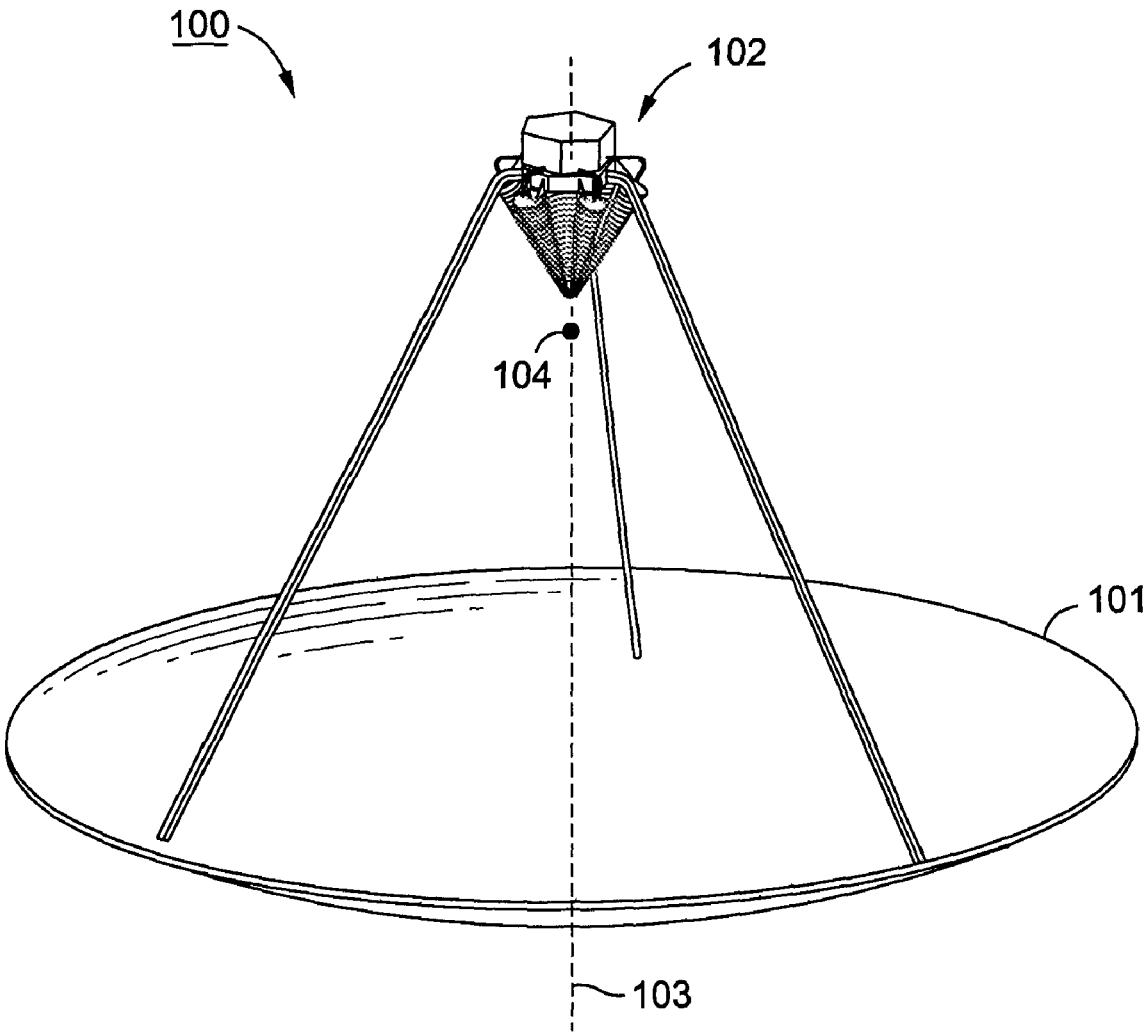
FIG. 1 illustrates an antenna system in accordance with one embodiment of the present invention.

FIG. 1 illustrates an antenna system 100 in accordance with one embodiment of the present invention. Antenna system 100 includes a parabolic reflector 101 and an array 102 of feed elements disposed on an axis 103 of reflector 101. The feed elements of array 102 are disposed such that each feed element is the same distance in wavelengths from the focal point 104 of reflector 101 as every other feed element.

Figure 2:
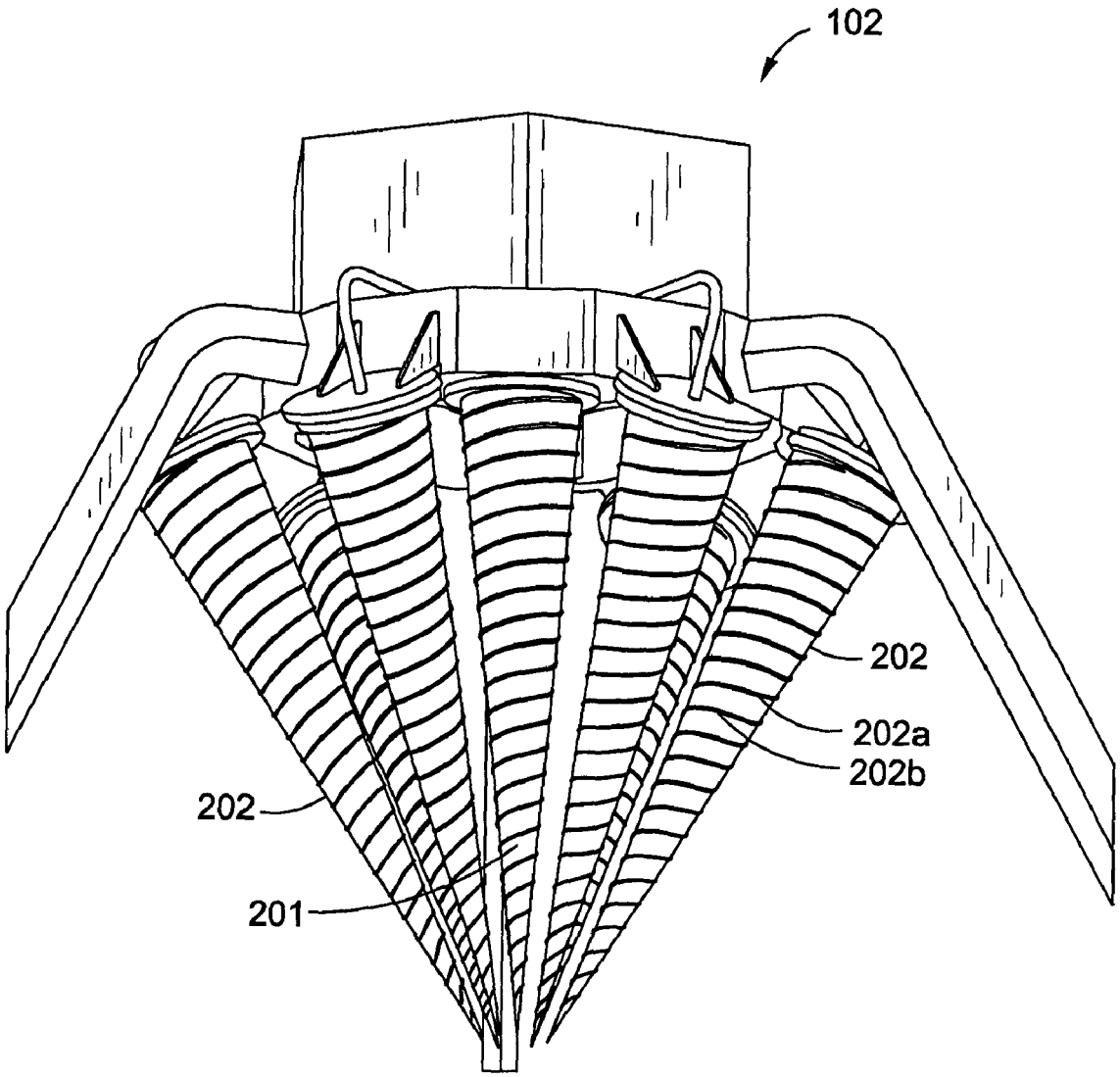
FIG. 2 illustrates an array of feed elements of an antenna system in accordance with one aspect of the present invention.

FIG. 2 illustrates array 102 of feed elements in greater detail, in accordance with one aspect of the present invention. Array 102 includes a central feed element 201 located on-axis, and a ring of feed elements, such as elements 202, surrounding central feed element 201. Each feed element is a wideband circularly polarized conical element, including two spiral conductive elements, such as conductive elements 202*a* and 202*b*. This design allows the phase center of each feed element to move further away from reflector 101 as the frequency decreases. Since each feed element is disposed a same distance in wavelengths from focal point 104 of reflector 101, however, the phase center of each feed element remains the same number of wavelengths distant from focal point 104, allowing for wide instantaneous bandwidth.

The location of array 102 is fixed in relation to reflector 104, so that when the phase centers of the feeds move, the resultant phase error is automatically incorporated into the secondary patterns and gain. This design allows antenna system 100 to be geometrically frequency independent, as the phase center of each feed element is at a constant offset (in wavelengths) from the center of the array (e.g., the point where the virtual apex of each feed element is located). According to one aspect of the present invention, the center of the array may be located at the focal point of the parabolic reflector. According to another aspect of the present invention, the center of the array may be offset from the focal point, so that the array phase center is collocated with the focal point at an operating frequency of the antenna system (e.g., the highest operating frequency thereof).

While the foregoing exemplary embodiment has been described with reference to feed elements having circularly polarized 2-arm conical spirals, the scope of the present invention is not limited to such an arrangement. Rather, as will be readily apparent to those of skill in the art, the present invention has application to a wide variety of antenna systems, such as those employing wideband feed elements configured as a linearly polarized log periodic dipole antenna ("LPDA"), a dual polarized sinuous antenna, or a dual polarized crossed LPDA. Moreover, while the foregoing exemplary embodiment has been described with reference to a parabolic reflector, the scope of the present invention is not limited to such an arrangement. Rather, as will be apparent to those of skill in the art, other reflector designs may also be used. For example, a cylindrical reflector may be provided with an array of feeds each of which is located a same distance from the focal line of the cylindrical reflector.

Figure 3:
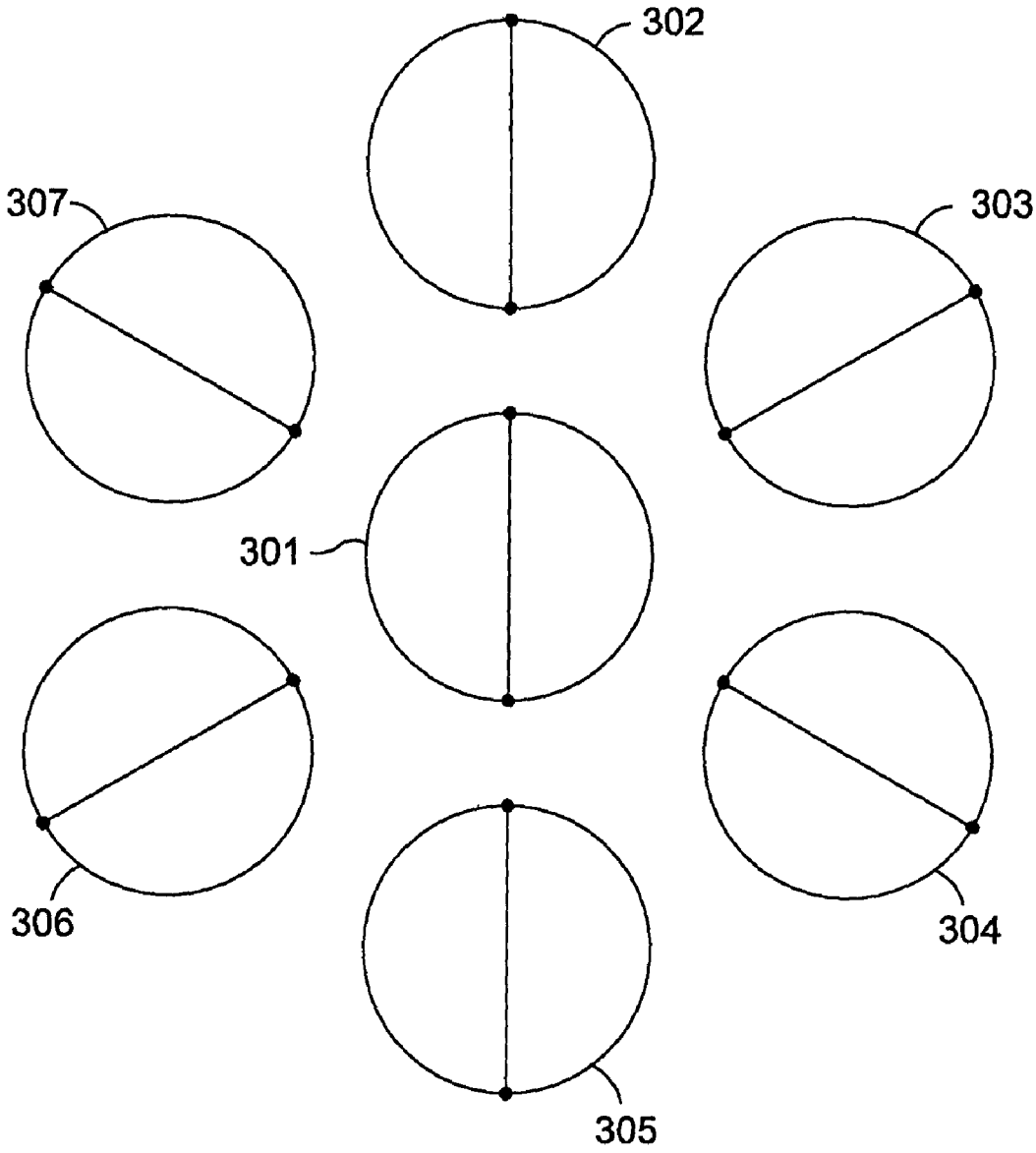
FIG. 3 illustrates an arrangement of feed elements of an antenna system in accordance with one aspect of the present invention.
Figure 4:
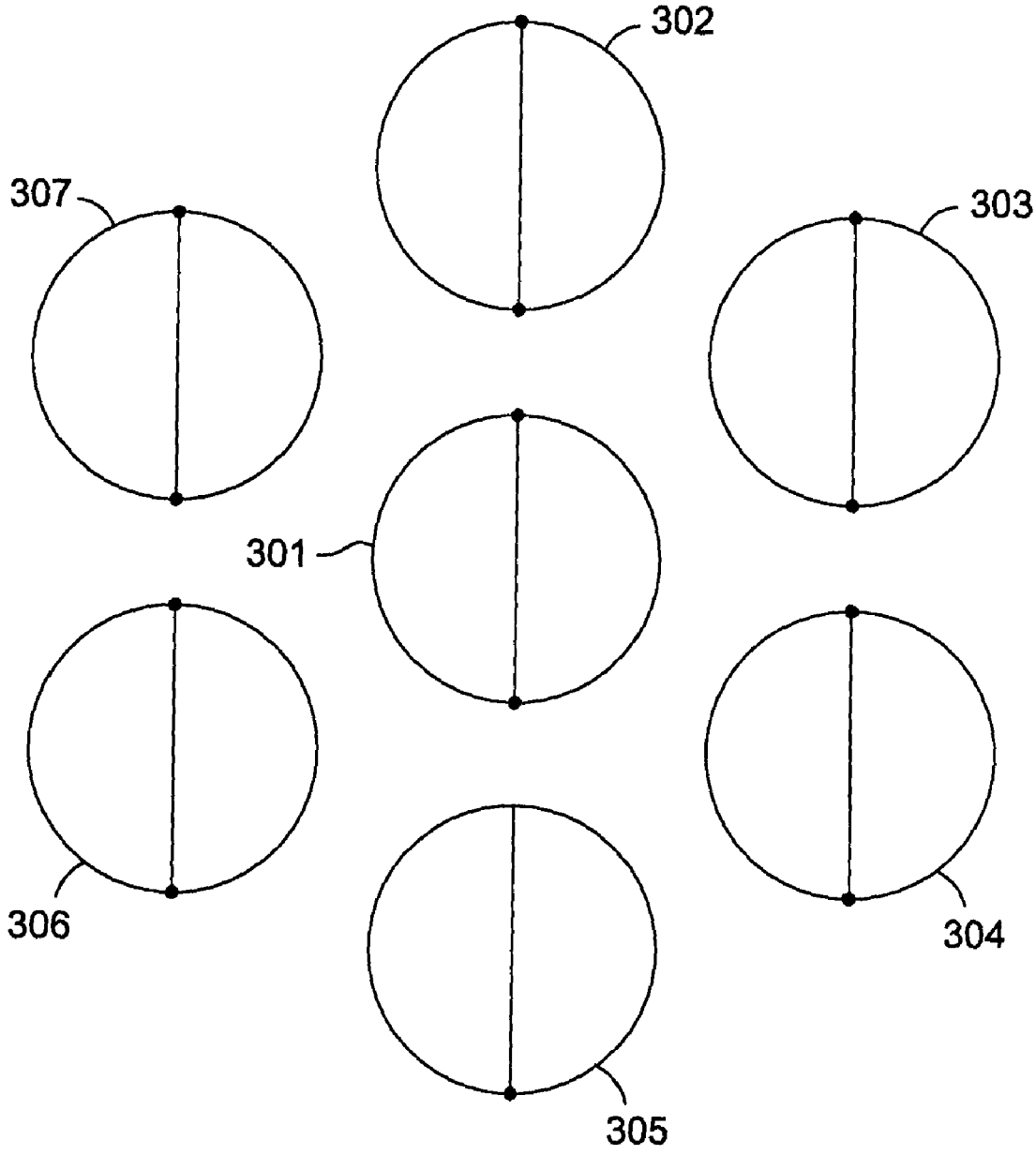
FIG. 4 illustrates an arrangement of feed elements of an antenna system in accordance with one aspect of the present invention.

In accordance with one aspect of the present invention, to eliminate the need for variable phase shifting in a beamforming network coupled to antenna system 100, the feed elements of array 102 may be rotated with respect to one another such that all of the feed elements are in-phase. For example, FIG. 3 illustrates an arrangement of feed elements of an antenna system in accordance with one aspect of the present invention, in which the outer feed elements 302-307 are each rotated according to their placement around the center feed element 301. This design requires the outer feed elements 302-307 to be phase-shifted by 0°, 60°, 120°, 180°, 240° and 300°, respectively, in order for all of feed elements 301-307 to be in-phase. To eliminate this phase-shifting requirement, feed elements 302-307 can be counter-rotated by an amount equal to the foregoing phase-shifted values, as illustrated in FIG. 4. By arranging the feed elements as shown in FIG. 4, wherein all of feed elements 301-307 are disposed with the same rotational disposition (e.g., when the spiral conductors of each feed element begin an/or end at the same radial position as every other feed element), no phase shifting of the signals provided to feed elements 302-307 is required to keep feed elements 301-307 in-phase.

According to another aspect of the present invention, the beamwidth of a beam produced by an antenna system so configured can be varied by adjusting only the amplitude of the signals fed to the feed elements thereof. Unlike other computationally-difficult approaches involving phase-shifting, by changing the relative amplitudes of the signals provided to the inner and outer feed elements, the width of the beam produced by the antenna system can be varied by a factor of 2 or more.

Figure 5A:
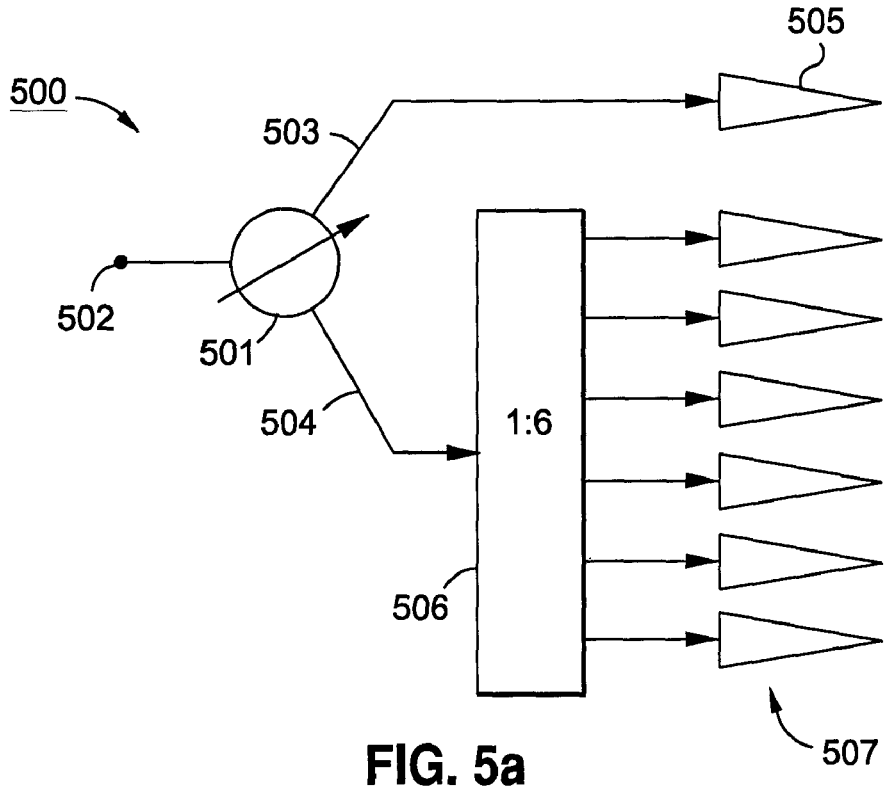
FIGS. 5*a* and 5*b* are block diagrams illustrating antenna systems according to various embodiments of the present invention.

For example, FIG. 5*a* illustrates an analog implementation of an amplitude-only beamforming solution, according to one embodiment of the present invention. Antenna system 500 includes a variable power combiner/divider 501, which receives an incoming signal 502 and selectably divides the power thereof into a first signal 503 with a first power level and a second signal 504 with a second power level. In accordance with various aspects of the present invention, variable power combiner/divider 501 may be digitally controlled, or alternately controlled in an analog fashion. First signal 503 is provided to the central feed element 505 of the feed array, while second signal 504 is provided to a 1:6 divider 506, which divides second signal 504 and provides it to the outer ring of feed elements 507. In this configuration, when more power is provided to first signal 503 relative to second signal 504, the beamwidth of the antenna system is narrowed, and when more power is provided to second signal 504 relative to first signal 503, the beamwidth of the antenna system is broadened. This effect may be more easily understood with reference to FIG. 6, which illustrates the variable beamwidth of the antenna system in graphical form. While antenna system 500 has been described with reference to transmitting a beam, those of skill in the art will immediately recognize that antenna system 500 may also be utilized in a receive configuration as well.

Figure 6:
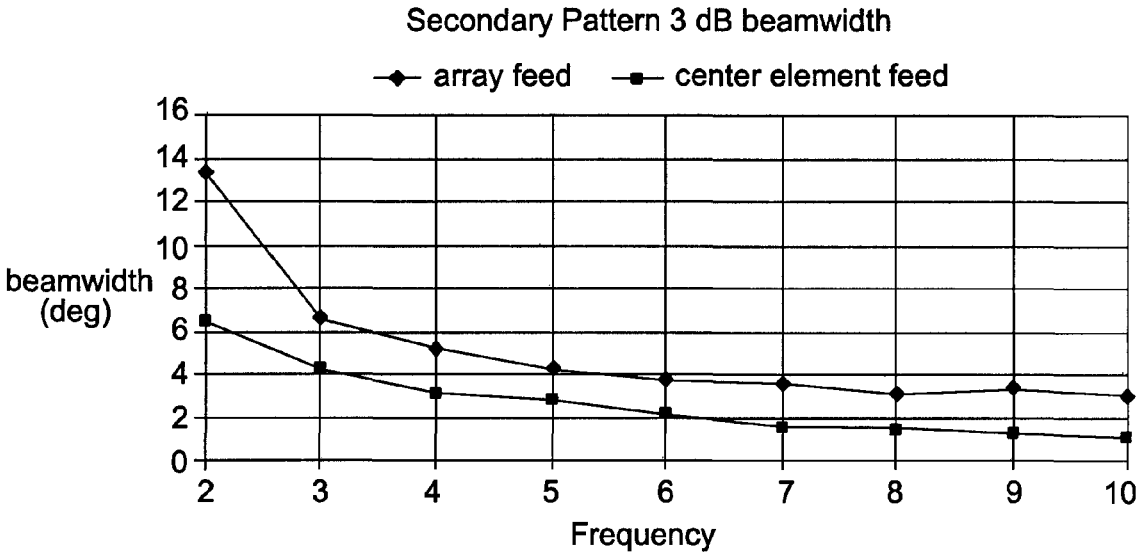
FIG. 6 is a graph illustrating a performance level enjoyed by an antenna system in accordance with one aspect of the present invention.

FIG. 6 illustrates the variable beamwidth of one exemplary embodiment of the present invention, in which the beamwidth provided by the antenna system may vary by a factor of 2. As can be seen with reference to FIG. 6, when the center feed element receives all of the power from variable power combiner/divider 501, the beamwidth of the antenna system is about half of the beamwidth when the entire array (both the center element and the outer ring of feed elements) is evenly illuminated. This remains the case for a large frequency range (e.g., between 2 and 10 GHz, as is illustrated in FIG. 6).

Figure 5B:
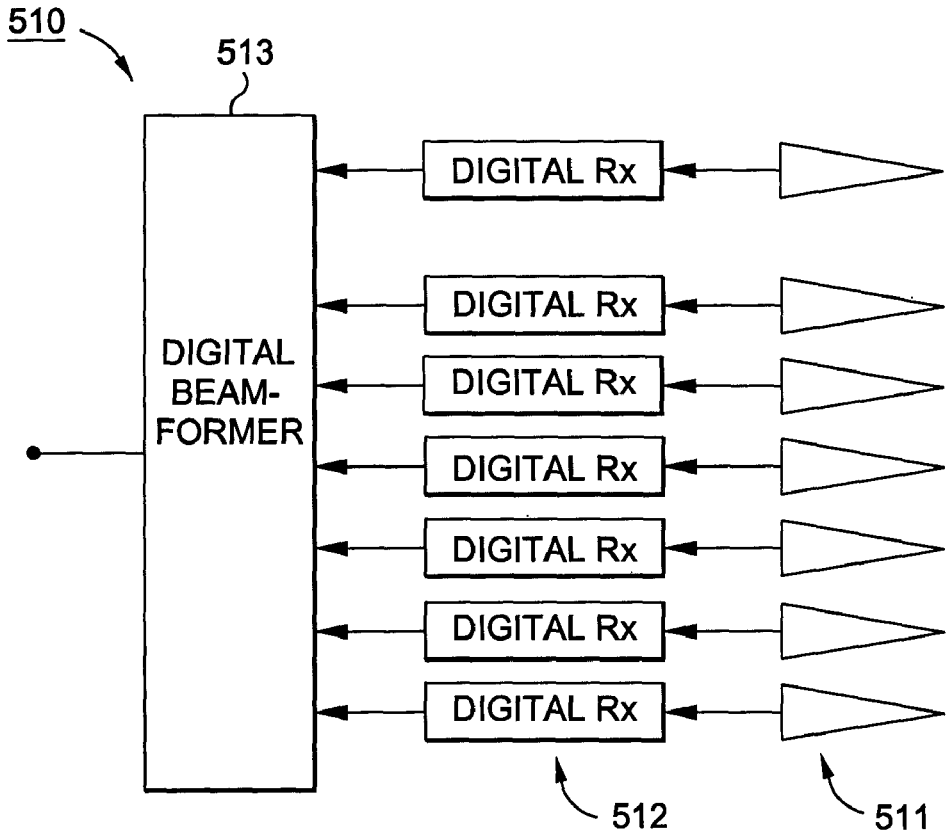

Turning to FIG. 5*b*, a digital implementation of a beamforming solution is illustrated in accordance with one embodiment of the present invention. While the digital implementation illustrated in FIG. 5*b* is described herein with reference to a receiver functionality, those of skill in the art will readily understand that the antenna system of FIG. 5*b* may also be used in a transmit configuration. Antenna system 510 includes a plurality of feed elements 511 (comprising both inner and outer feed elements). The signal received by each feed element 511 is provided to a corresponding digital receiver, which converts the signal from the analog to the digital domain. Each digital signal is then provided to a digital beamformer 513, which applies a complex weighting to each digital signal, and through the superposition thereof, produces an output beam. In this configuration, the relative weighting applied to the inner and outer elements can control the beamwidth of the antenna system, in a fashion similar to that set forth above (e.g., greater weighting for the inner elements reducing the beamwidth, and greater weighting for the outer elements broadening it).

According to one aspect of the present invention, by matching the path lengths of the signals received from each feed element in the antenna system, no variable phase shifters or other time delay modules are required to vary the beamwidth of the antenna system. Moreover, the system can be extended well beyond the 5:1 (e.g., 2 GHz to 10 GHz) frequency range.

Figure 7A:
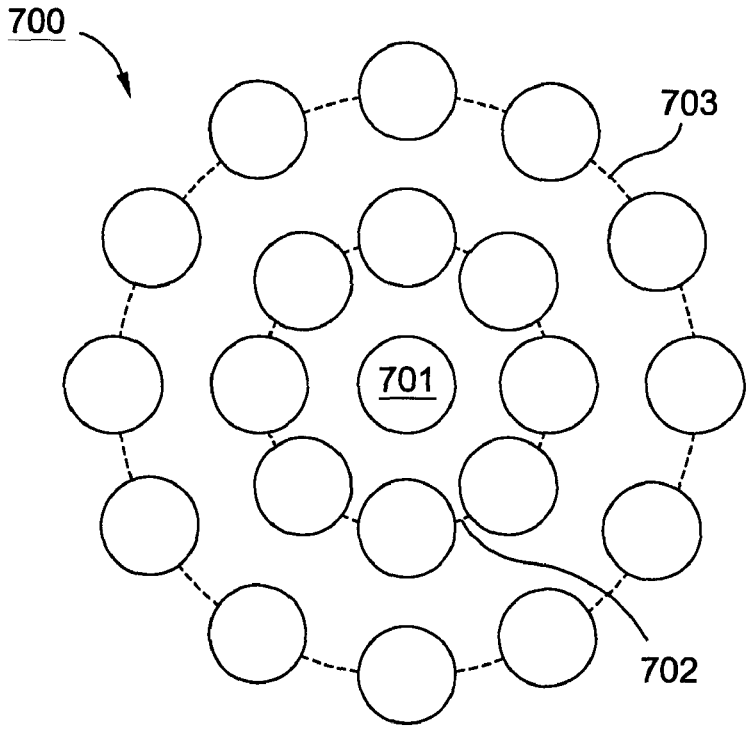
FIGS. 7*a* and 7*b* illustrate arrangements of feed elements of an antenna system in accordance with various aspects of the present invention.
Figure 7B:
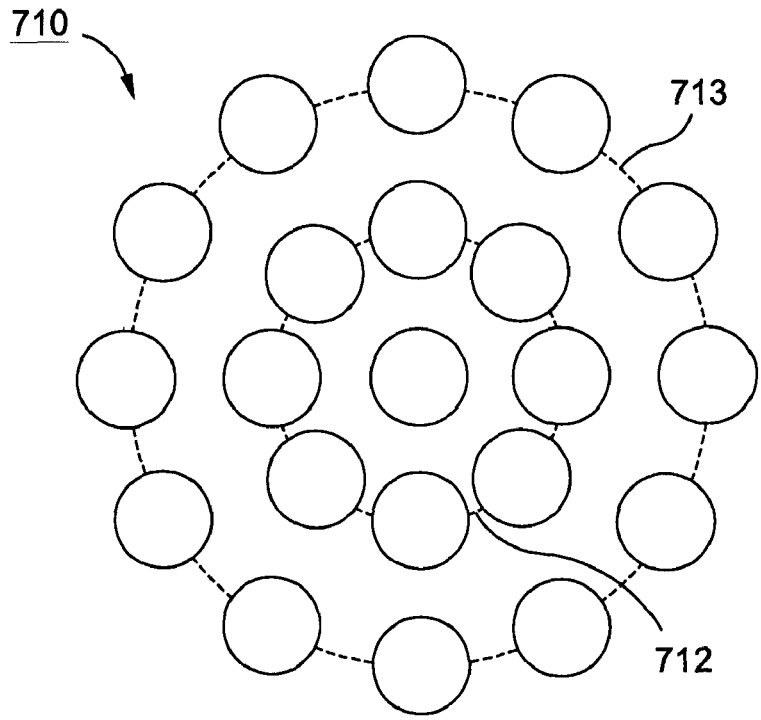

While the foregoing exemplary embodiments have been illustrated and described with reference to arrays with a single center element and an outer concentric ring of six elements, the scope of the present invention is not limited to such an arrangement. Rather, as will be apparent to those of skill in the art, the present invention has application to embodiments in which the arrays include multiple concentric rings of feed elements, with or without a single central feed element. For example, FIG. 7*a* illustrates an exemplary embodiment in which a feed array 700 includes a center feed element 701, a first concentric ring 702 of feed elements disposed around center feed element 701, and a second concentric ring 703 of feed elements disposed around first concentric ring 702. FIG. 7*b* illustrates yet another exemplary embodiment, in which a feed array 710 does not include a central element, but rather includes only a first ring 712 of feed elements and a concentric second ring 713 of feed elements. By selectably varying the power provided to or received from the different rings of feed elements, the beamwidth of an antenna system including such a feed array can be varied without expensive and computationally difficult variable phase shifting.

According to one aspect of the present invention, an antenna system incorporating an amplitude-only beamwidth adjustable feed array such as those described in greater detail above can excite multiple modes. Accordingly, in some embodiments, antenna systems of the present invention may be used in direction finding applications.

Figure 8:
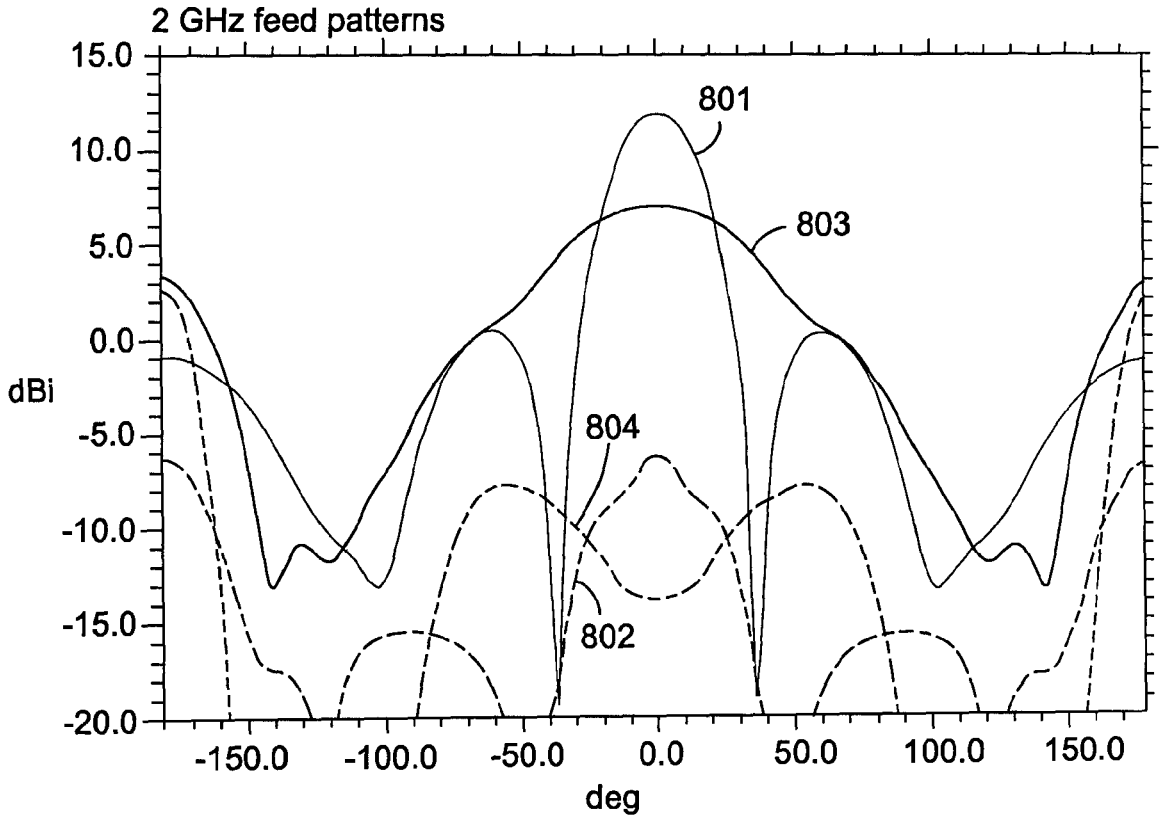
FIGS. 8 to 10 are graphs illustrating exemplary reflector feed patterns at 2 GHz, 6 GHz and 10 GHz, respectively, in accordance with various aspects of the present invention.
Figure 9:
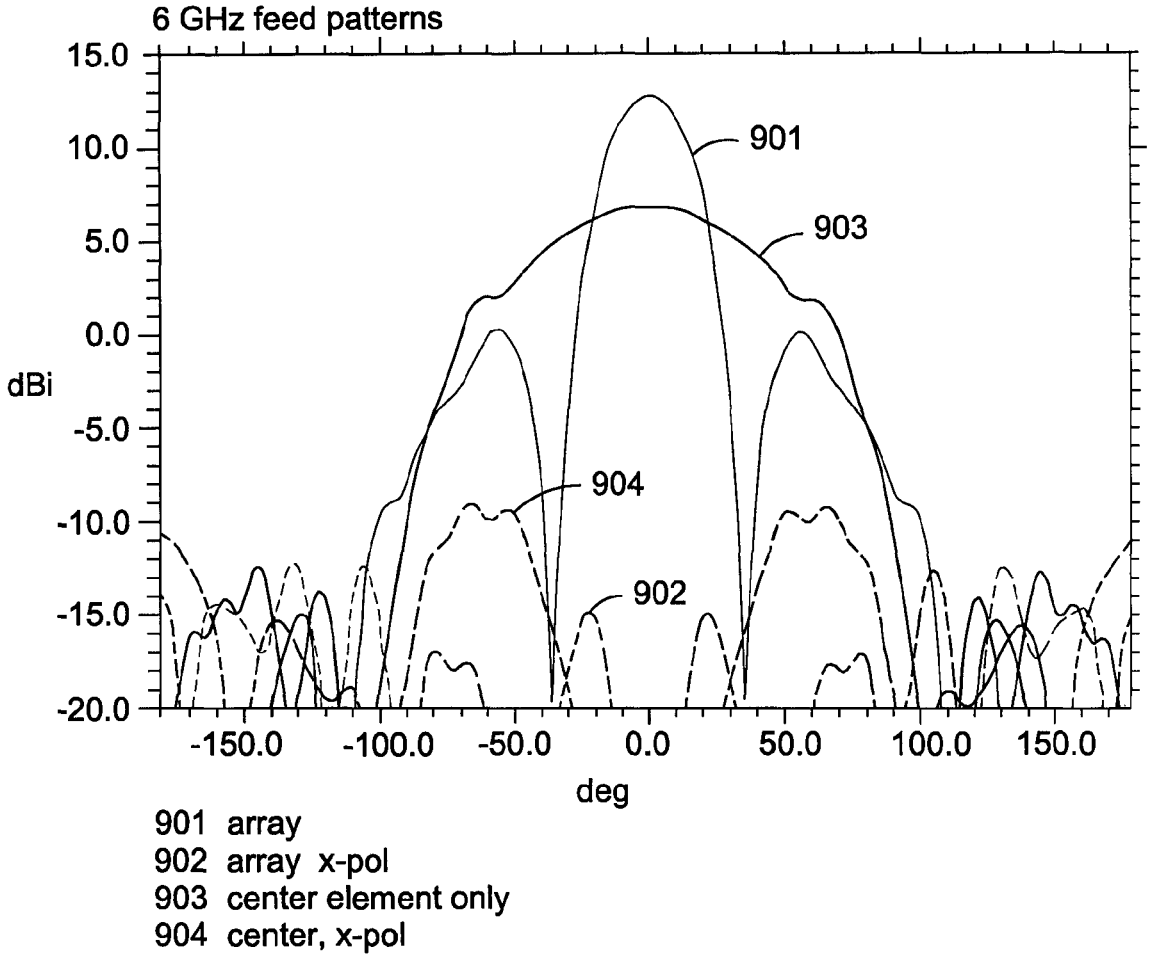
Figure 10:
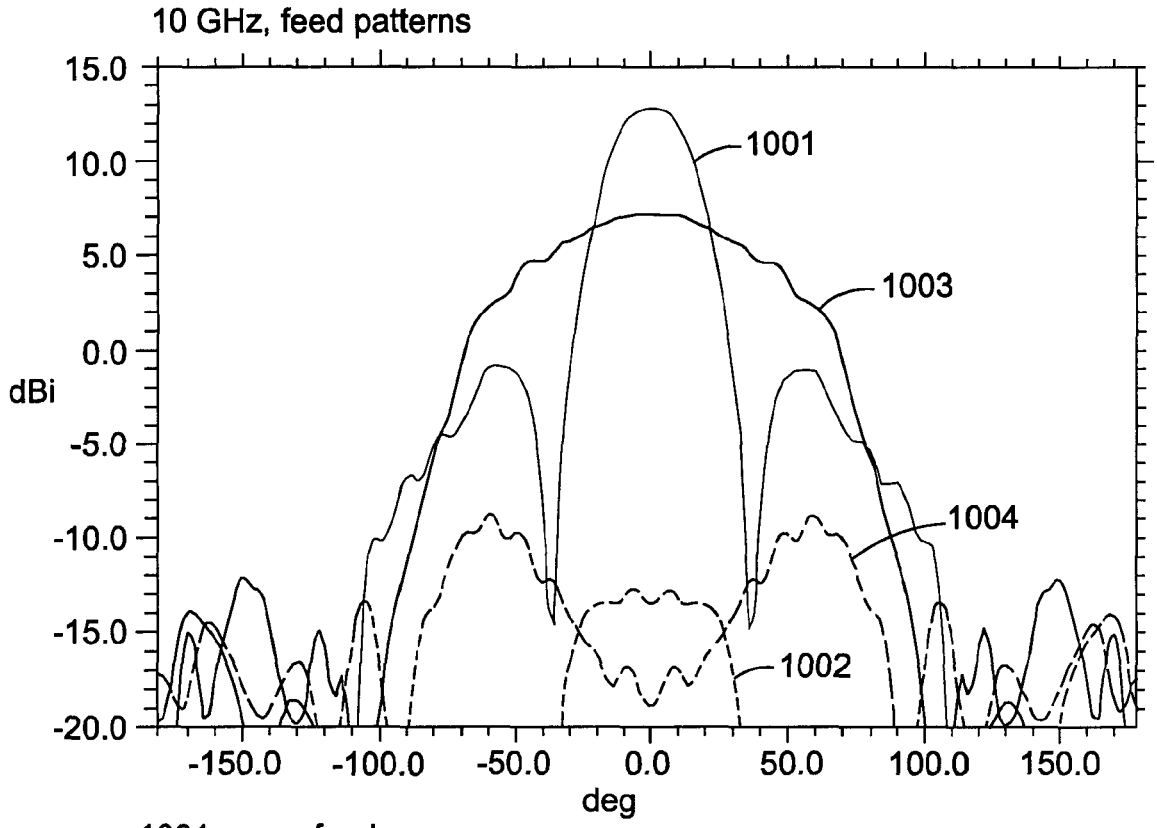

FIGS. 8 to 10 are graphs illustrating feed patterns of an exemplary antenna system in accordance with various aspects of the present invention. FIG. 8 illustrates, for a low-frequency (2 GHz) implementation of the antenna system, the feed pattern 801 of the entire array (i.e., the center element and the outer ring of elements uniformly illuminated), the cross-polar pattern 802 thereof, and the feed pattern 803 for the center feed element only, and the cross-polar pattern 804 thereof. FIG. 9 illustrates, for a medium-frequency (6 GHz) implementation of the antenna system, the feed pattern 901 of the entire array, the cross-polar pattern 902 thereof, and the feed pattern 903 for the center feed element only, and the cross-polar pattern 904 thereof. FIG. 10 illustrates, for a high-frequency (10 GHz) implementation of the antenna system, the feed pattern 1001 of the entire array, the cross-polar pattern 1002 thereof, and the feed pattern 1003 for the center feed element only, and the cross-polar pattern 1004 thereof. As can be seen with reference to FIGS. 8 to 10, this exemplary analysis shows approximately 1 dB of directivity and 1-2 dB gain roll-off at the band edges. The roll-off at the low frequency (2 GHz) was due to a truncation of the spiral geometry (i.e., the spiral conductive element selected for the test was not sufficiently long to accommodate truncation effects). This also caused the increase in the cross-polar pattern at this frequency (e.g., caused by reflections off the end of the spiral).

Figure 11:
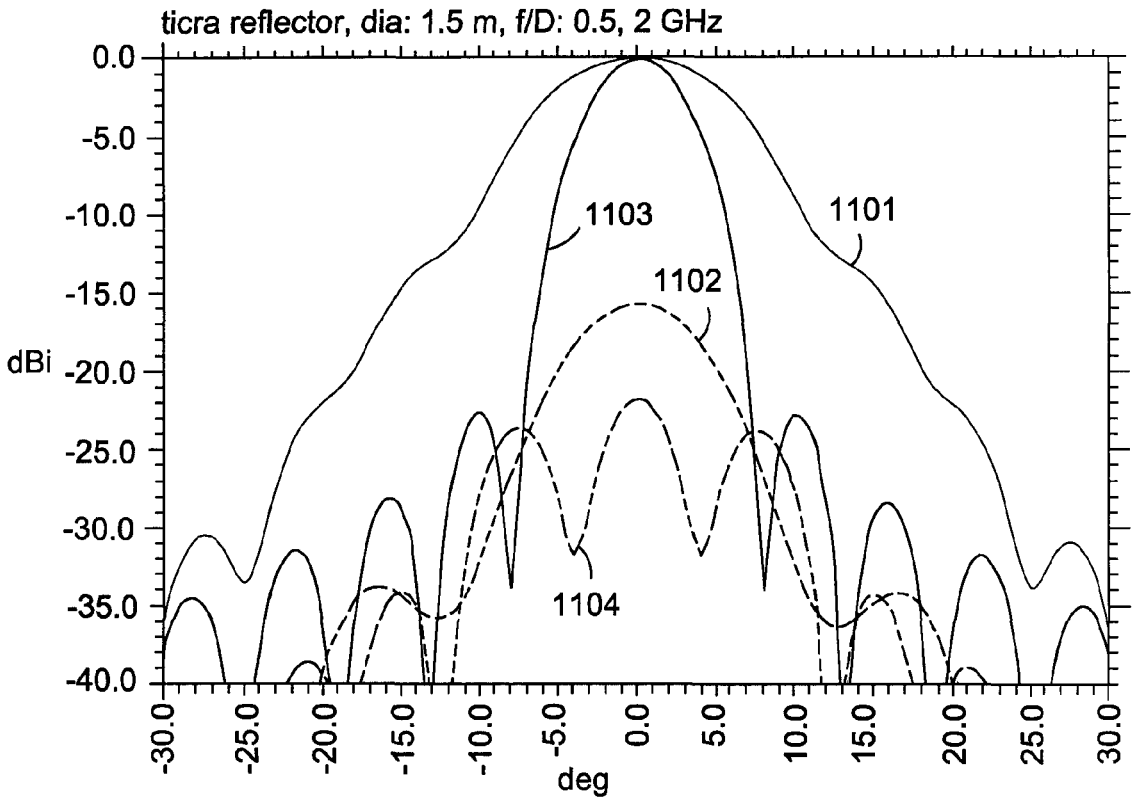
FIGS. 11 to 13 are graphs illustrating exemplary reflector secondary patterns at 2 GHz, 6 GHz and 10 GHz, respectively, in accordance with various aspects of the present invention.
Figure 12:
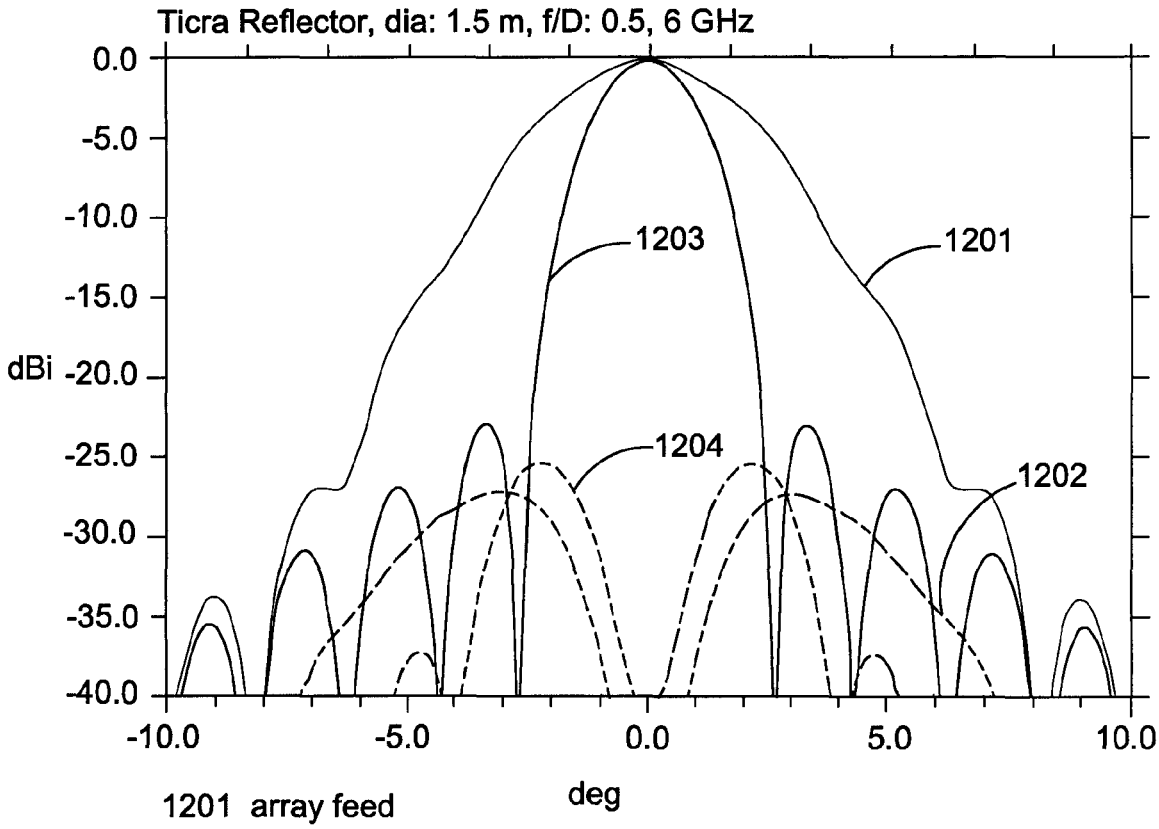
Figure 13:
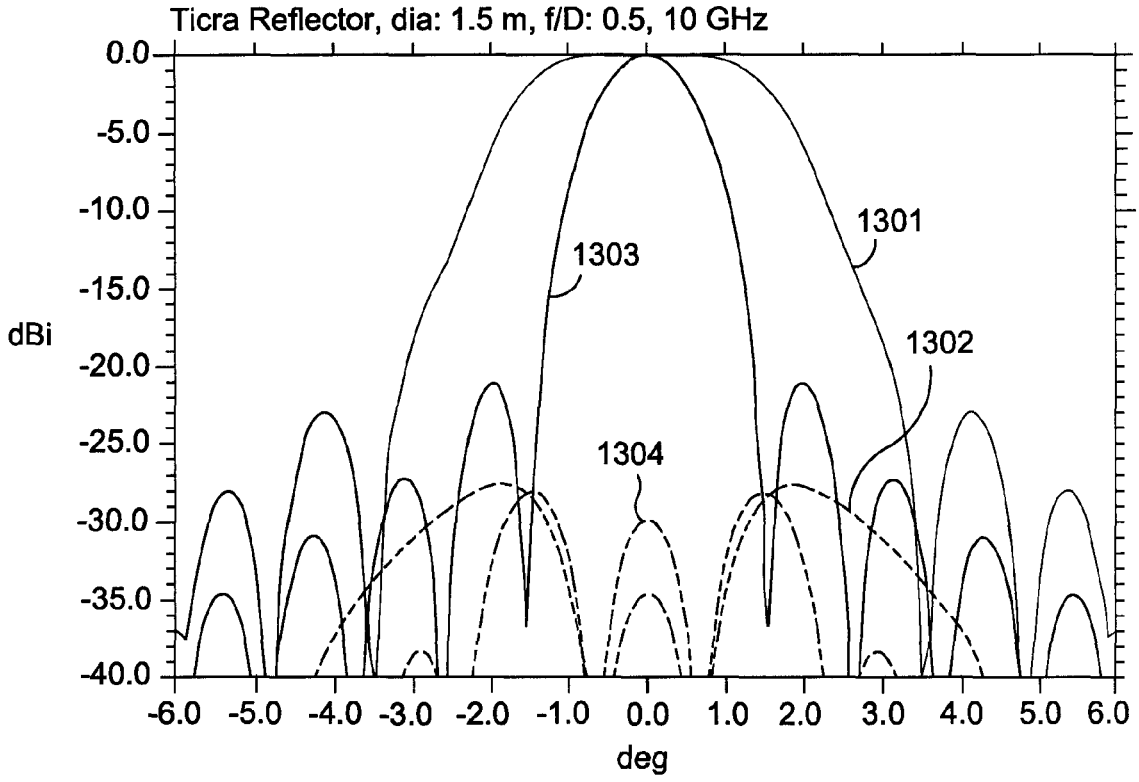

FIGS. 11 to 13 are graphs illustrating reflector secondary patterns of an exemplary antenna system in accordance with various aspects of the present invention. These patterns were generated with NEC feeds input in to Ticra GRASP9, with identical phasing for each element. FIG. 11 illustrates, for a low-frequency (2 GHz) implementation of the antenna system, the feed pattern 1101 of the entire array (i.e., the center element and the outer ring of elements uniformly illuminated), the cross-polar pattern 1102 thereof, and the secondary pattern 1103 for the center feed element only, and the cross-polar pattern 1104 thereof. FIG. 12 illustrates, for a medium-frequency (6 GHz) implementation of the antenna system, the secondary pattern 1201 of the entire array, the cross-polar pattern 1202 thereof, and the secondary pattern 1203 for the center feed element only, and the cross-polar pattern 1204 thereof. FIG. 13 illustrates, for a high-frequency (10 GHz) implementation of the antenna system, the secondary pattern 1301 of the entire array, the cross-polar pattern 1302 thereof, and the secondary pattern 1303 for the center feed element only, and the cross-polar pattern 1304 thereof. As can be seen with reference to FIGS. 11 to 13, the relative secondary pattern beamwidth corresponding to the center feed element only is much less than when the entire array of feed elements (including the center element) is evenly illuminated.

Figure 14:
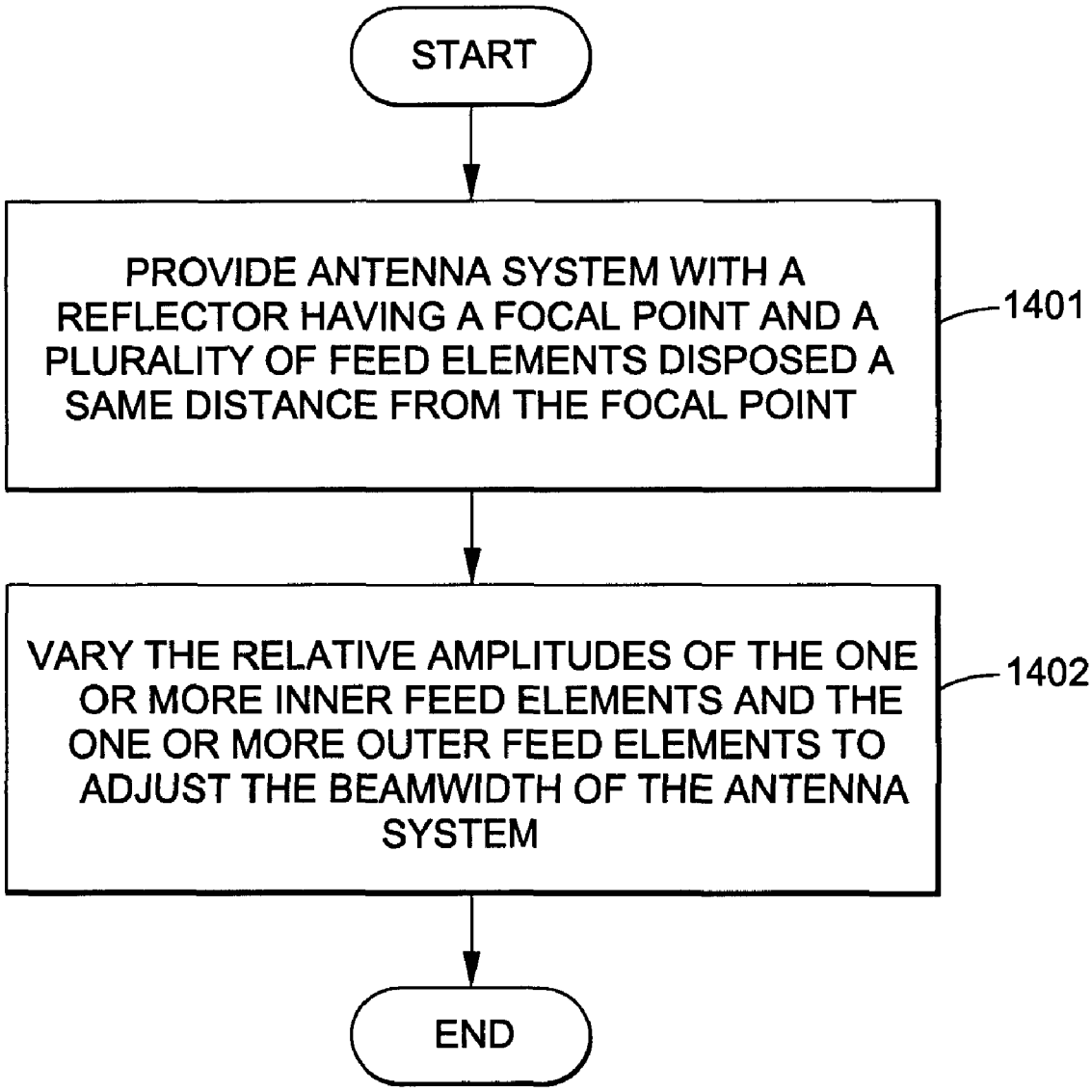
FIG. 14 is a flow chart illustrating a method for varying the beamwidth of an antenna system in accordance with one embodiment of the present invention.

FIG. 14 is a flow chart illustrating a method for varying the beamwidth of an antenna system in accordance with one embodiment of the present invention. The method begins with step 1401, in which an antenna system is provided with a reflector having a focal point and a plurality of feed elements disposed a same distance from the focal point. The plurality of feed elements includes one or more inner feed elements and one or more outer feed elements. In step 1402, the relative amplitudes of the one or more inner feed elements and the one or more outer feed elements are varied to adjust the beamwidth of the antenna system. For example, when more amplitude is provided to the one or more inner feed elements relative to the one or more outer feed elements, the beamwidth of the antenna system is narrowed. Alternatively, when more amplitude is provided to the one or more outer feed elements relative to the one or more inner feed elements, the beamwidth of the antenna system is broadened.

Figure 15:
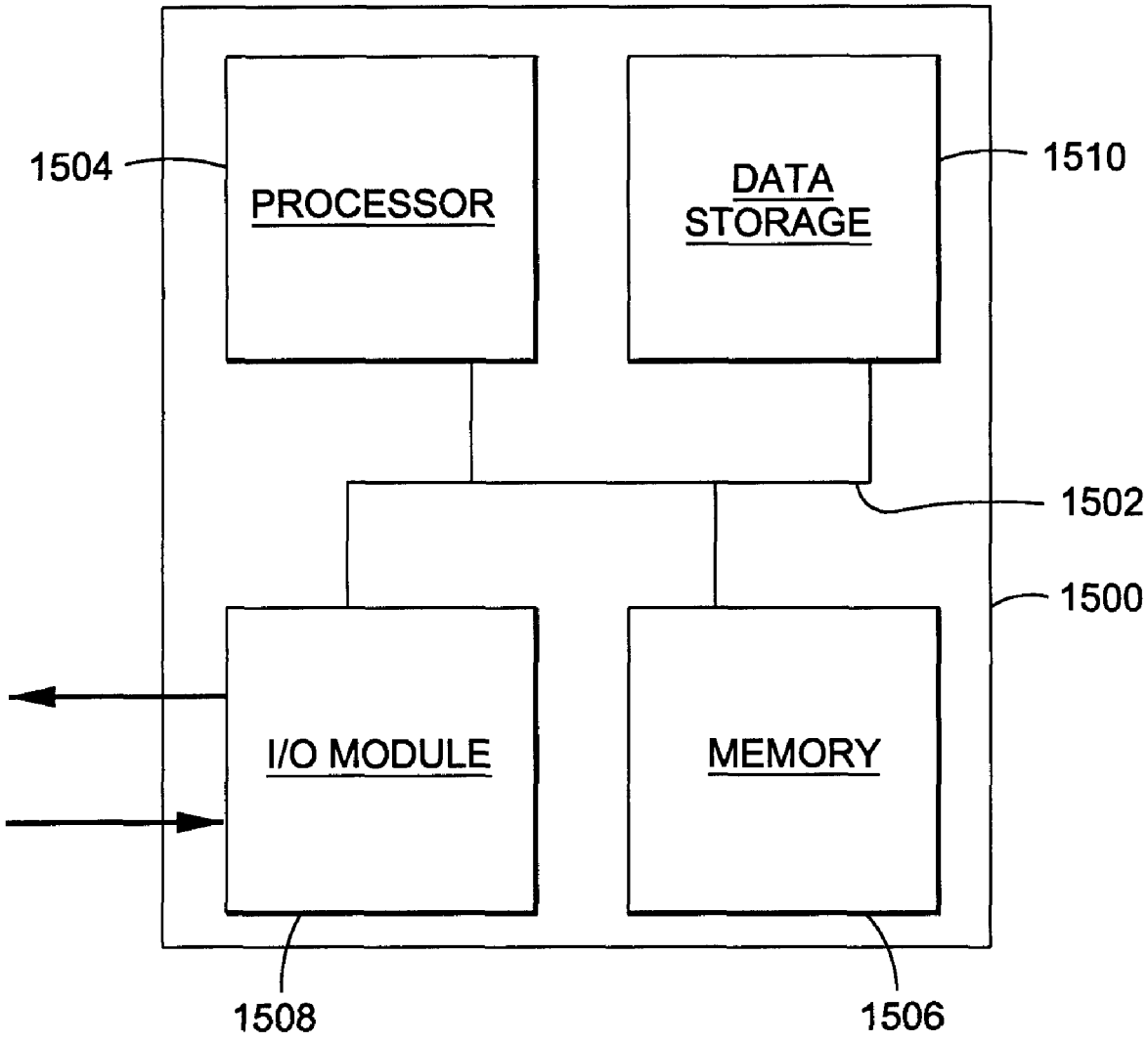
FIG. 15 is an illustration of a computer system upon which one embodiment of the present invention may be performed.

FIG. 15 is a block diagram that illustrates a computer system 1500 upon which an embodiment of the present invention may be implemented. Computer system 1500 includes a bus 1502 or other communication mechanism for communicating information, and a processor 1504 coupled with bus 1502 for processing information. Computer system 1500 also includes a memory 1506, such as a random access memory ("RAM") or other dynamic storage device, coupled to bus 1502 for storing information and instructions to be executed by processor 1504. Memory 1506 may also be used for storing temporary variables or other intermediate information during execution of instructions by processor 1504. Computer system 1500 further includes a data storage device 1510, such as a magnetic disk or optical disk, coupled to bus 1502 for storing information and instructions.

Computer system 1500 may be coupled via I/O module 1508 to a display device (not illustrated), such as a cathode ray tube ("CRT") or liquid crystal display ("LCD") for displaying information to a computer user. An input device, such as, for example, a keyboard or a mouse may also be coupled to computer system 1500 via I/O module 1508 for communicating information and command selections to processor 1504.

According to one embodiment of the present invention, varying the beamwidth of an antenna system is performed by a computer system 1500 in response to processor 1504 executing one or more sequences of one or more instructions contained in memory 1506. Such instructions may be read into memory 1506 from another machine-readable medium, such as data storage device 1510. Execution of the sequences of instructions contained in main memory 1506 causes processor 1504 to perform the process steps described herein. One or more processors in a multi-processing arrangement may also be employed to execute the sequences of instructions contained in memory 1506. In alternative embodiments, hard-wired circuitry may be used in place of or in combination with software instructions to implement various embodiments of the present invention. Thus, embodiments of the present invention are not limited to any specific combination of hardware circuitry and software.

The term "machine-readable medium" as used herein refers to any medium that participates in providing instructions to processor 1504 for execution. Such a medium may take many forms, including, but not limited to, non-volatile media, volatile media, and transmission media. Non-volatile media include, for example, optical or magnetic disks, such as data storage device 1510. Volatile media include dynamic memory, such as memory 1506. Transmission media include coaxial cables, copper wire, and fiber optics, including the wires that comprise bus 1502. Transmission media can also take the form of acoustic or light waves, such as those generated during radio frequency and infrared data communications. Common forms of machine-readable media include, for example, floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH EPROM, any other memory chip or cartridge, a carrier wave, or any other medium from which a computer can read.

The description of the invention is provided to enable any person skilled in the art to practice the various embodiments described herein. While the present invention has been particularly described with reference to the various figures and embodiments, it should be understood that these are for illustration purposes only and should not be taken as limiting the scope of the invention.

There may be many other ways to implement the invention. Various functions and elements described herein may be partitioned differently from those shown without departing from the spirit and scope of the invention. Various modifications to these embodiments will be readily apparent to those skilled in the art, and generic principles defined herein may be applied to other embodiments. Thus, many changes and modifications may be made to the invention, by one having ordinary skill in the art, without departing from the spirit and scope of the invention.

A reference to an element in the singular is not intended to mean "one and only one" unless specifically stated, but rather "one or more." The term "some" refers to one or more. Underlined and/or italicized headings and subheadings are used for convenience only, do not limit the invention, and are not referred to in connection with the interpretation of the description of the invention. All structural and functional equivalents to the elements of the various embodiments of the invention described throughout this disclosure that are known or later come to be known to those of ordinary skill in the art are expressly incorporated herein by reference and intended to be encompassed by the invention. Moreover, nothing disclosed herein is intended to be dedicated to the public regardless of whether such disclosure is explicitly recited in the above description.

What is claimed is:

1. An antenna system comprising:

a reflector having a focal point; and a phased array having a plurality of feed elements, each of the plurality of feed elements being disposed a same distance in wavelengths from the focal point of the reflector, wherein the plurality of feed elements includes a center feed element and a ring of feed elements disposed around the center feed element, and wherein a phase center of each of the plurality of feed elements moves as the operating frequency changes such that a distance of the phase center in wavelengths from the focal point remains substantially the same.

2. The antenna system of claim 1, wherein the reflector is a parabolic reflector.

3. The antenna system of claim 1, wherein each of the plurality of feed elements is oriented towards the focal point.

4. The antenna system of claim 1, wherein the phased array is disposed on an axis of the reflector.

5. The antenna system of claim 1, wherein each of the plurality of feed elements includes at least one conical spiral conductive element.

6. The antenna system of claim 1, wherein the plurality of feed elements are rotated with respect to one another such that the plurality of feed elements are in-phase.

7. The antenna system of claim 1, wherein the plurality of feed elements further includes a second ring of feed elements concentric with the ring of feed elements and surrounding the first ring of feed elements.

8. The antenna system of claim 1, further comprising one or more amplitude varying elements, whereby relative amplitudes of the center feed element and of the ring of feed elements are adjusted.

9. The antenna system of claim 8, further comprising a controller configured to vary the relative amplitudes of the center feed element and of the ring of feed elements using the one or more amplitude varying elements to control a beamwidth of the antenna system.

10. The antenna system of claim 1, wherein the plurality of feed elements include a plurality of conical spiral conductive elements that are rotated with respect to one another such that the plurality of feed elements are in-phase, further comprising:

one or more amplitude varying elements configured to adjust relative amplitudes of the center feed element and of the ring of feed elements; and a controller configured to vary the relative amplitudes of the center feed element and of the ring of feed elements using the one or more amplitude varying elements to control a beamwidth of the antenna system.

11. An antenna system comprising:

a parabolic reflector having a focal point; and a phased array having one or more inner feed elements and one or more outer feed elements, each of the one or more inner feed elements and the one or more outer feed elements being disposed a same distance in wavelengths from the focal point of the reflector and oriented towards the focal point of the reflector, wherein a phase center of each of the one or more inner feed elements and one or more outer feed elements moves as the operating frequency changes such that a distance of the phase center in wavelengths from the focal point remains substantially the same.

12. The antenna system of claim 11, wherein the phased array is disposed on an axis of the reflector.

13. The antenna system of claim 11, wherein each of the one or more inner feed elements and each of the one or more outer feed elements includes at least one conical spiral conductive element.

14. The antenna system of claim 11, wherein the one or more inner feed elements and the one or more outer feed elements are rotated with respect to one another such that the one or more inner feed elements and the one or more outer feed elements are in-phase.

15. The antenna system of claim 11, further comprising one or more amplitude varying elements, whereby relative amplitudes of the one or more inner feed elements and of the one or more outer feed elements are adjusted.

16. The antenna system of claim 15, further comprising a controller configured to vary the relative amplitudes of the one or more inner feed elements and of the one or more outer feed elements using the one or more amplitude varying elements to control a beamwidth of the antenna system.

17. A method for varying the beamwidth of an antenna system, the method comprising the steps of:

providing the antenna system with a reflector having a focal point and a plurality of feed elements disposed a same distance in wavelengths from the focal point, wherein the plurality of feed elements includes one or more inner feed elements and one or more outer feed elements, wherein a phase center of each of the plurality of feed elements moves as the operating frequency changes such that a distance of the phase center in wavelengths from the focal point remains substantially the same; and adjusting relative amplitudes of the one or more inner feed elements and the one or more outer feed elements to adjust the beamwidth of the antenna system.

* * * * *